United States Patent [19]

Biermann et al.

[11] 4,363,498

[45] Dec. 14, 1982

[54] CROSS COUNTRY SKI BINDING

[75] Inventors:. Peter Biermann, Warmbronn; Otto Ewald, Griesheim; Rudi Feucht, Weissach; Manfred Schmidt, Sindelfingen, all of Fed. Rep. of Germany

[73] Assignee: Geze GmbH, Leonberg, Fed. Rep. of Germany

[21] Appl. No.: 818,741

[22] Filed: Jul. 25, 1977

[30] Foreign Application Priority Data

Jul. 24, 1976 [DE] Fed. Rep. of Germany ..... 2633373

[51] Int. Cl.[3] ..... A63C 9/00

[52] U.S. Cl. ..... 280/615; 36/117; 280/635

[58] Field of Search ..... 280/615, 614, 611, 636, 280/635; 36/117, 118, 119, 120, 121, 122, 123, 124, 125, 116

[56] References Cited

U.S. PATENT DOCUMENTS

| | | | |
|---|---|---|---|
| 2,022,580 | 11/1935 | Utterstrom | 280/615 |
| 2,246,152 | 6/1941 | Wallace | 280/614 |
| 3,603,606 | 9/1971 | Eie | 280/615 |
| 3,925,911 | 12/1975 | Erlebach | 280/611 X |
| 3,957,280 | 5/1976 | Turnheim et al. | 280/636 |
| 4,004,823 | 1/1977 | Pyzel et al. | 280/615 |
| 4,108,467 | 8/1978 | Kreyenbuhl | 280/615 |
| 4,129,319 | 12/1978 | Strohmeier | 280/615 |

FOREIGN PATENT DOCUMENTS

| | | | |
|---|---|---|---|
| 2610041 | 10/1976 | Fed. Rep. of Germany | 280/615 |
| 322456 | 11/1934 | Italy | 280/615 |
| 64864 | 5/1942 | Norway | 280/615 |
| 109756 | 2/1944 | Sweden | 280/615 |
| 113817 | 10/1945 | Sweden | 280/615 |
| 161590 | 7/1933 | Switzerland | 280/615 |
| 234906 | 5/1969 | U.S.S.R. | 280/615 |

*Primary Examiner*—Joseph F. Peters, Jr.
*Assistant Examiner*—Milton L. Smith
*Attorney, Agent, or Firm*—Paul M. Craig, Jr.

[57] ABSTRACT

A cross country ski binding has a support element attachable directly to a ski for engaging a forwardly extending boot sole extension, and is also provided with latching mechanism for latching the sole extension to the supporting element, under imposition of spring forces. The cross country ski binding may include spring biased detent members engageable into detent provisions provided directly on the boot sole extension, such that the forward part of the ski boot is automatically locked in position upon insertion of the boot sole extension into the support element. Preferred embodiments of the invention include those accommodating an axial movement of the boot sole extension into the support element and latching mechanism, as well as embodiments wherein the boot sole extension is placed downwardly over a pivot pin forming part of the holding mechanism. Also, certain embodiments of the invention include additional locking levers for locking the latching mechanism in a latched position. Further, certain preferred embodiments include camming means, as well as ratchet and pawl means for performing the latching function interconnecting the support element and the cross country ski boot sole extension.

39 Claims, 38 Drawing Figures

Fig. 13
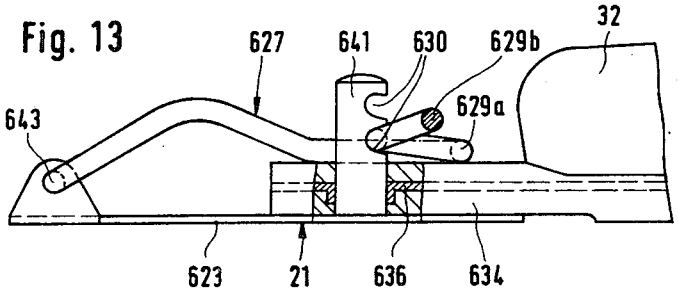
Fig. 14
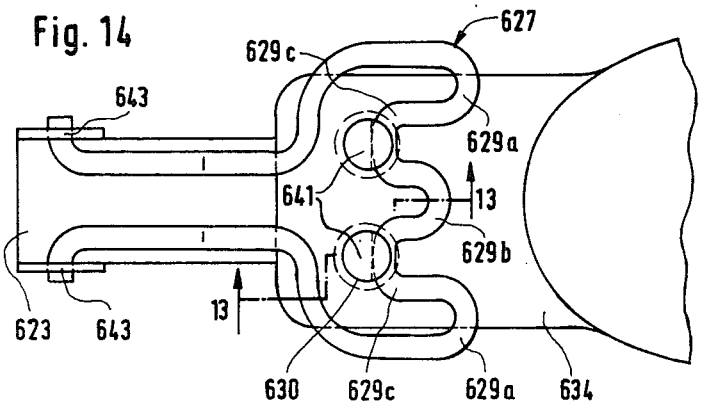
Fig. 17
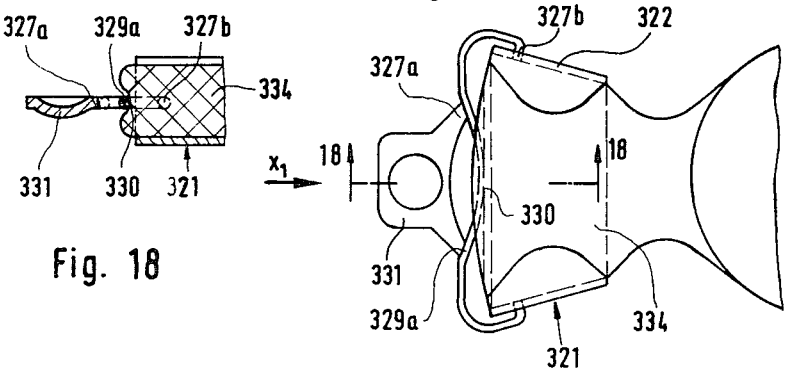
Fig. 18

Fig. 32
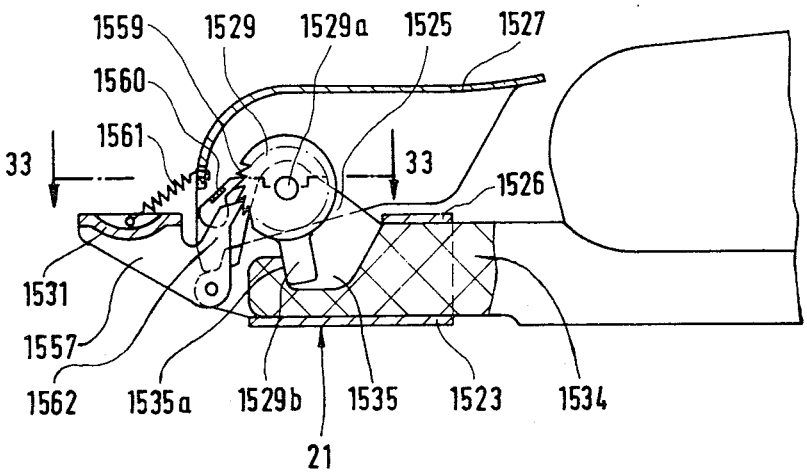
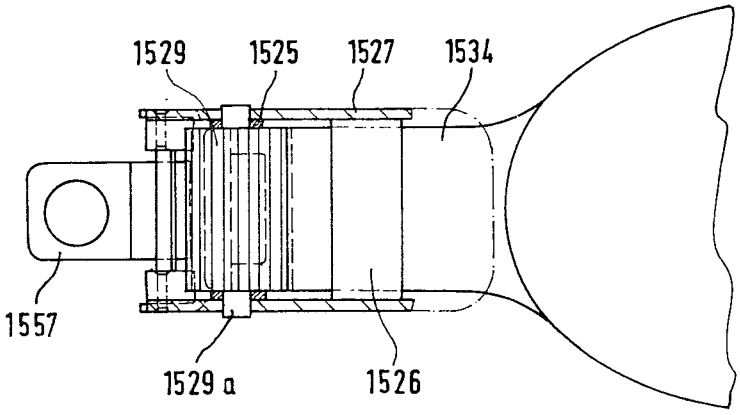
Fig. 33

CROSS COUNTRY SKI BINDING

BACKGROUND AND SUMMARY OF THE INVENTION

The invention relates to cross country ski bindings with a support element attachable directly to a ski for engaging a forwardly extending sole extension and being liftable from the ski at its rearward end.

Cross country ski bindings are known (German Utility Model No. 7,505,336) with forward lateral jaws, a strap articulated to the lateral jaws, said strap lying over the forward part of the boot sole in one functional position and being lockable in this position. However, such bindings have the particular disadvantage of being boot-dependent, i.e., the lateral centering of the boot sole requires a plurality of bindings for different boot sizes as well as different designs for right and left boots. Therefore, such bindings are cumbersome, costly, and to a certain extent, too heavy. The sidewise projection of the lateral jaws beyond the edge of the ski also has a disadvantageous effect upon the guidance of the ski.

Cross country ski bindings have also been contemplated wherein the above-mentioned disadvantages are eliminated by a forward extension of the boot sole, thereby providing freedom of design for the cross country ski binding by virtue of this boot sole extension, and permitting use of only one binding for right and left boots as well as for different boot sizes. In this design, the boot sole is lockable by means of a cross bolt. However, operation of said bolt is troublesome and uncomfortable such that it is impractical and inconvenient for bindings intended for normal skiers.

An important object of the invention is to provide a binding of the simplest possible construction, said binding also being inexpensive and light in weight, which binding is independent of the boot sole and does not project sidewise beyond the ski, in addition to being easily attached to and removed from the ski. In particular, a reliable grip must be provided even when there is snow on the boot sole.

This object is obtained according to the invention by providing that the sole extension is automatically latchable and/or lockable under spring tension to the ski.

The following advantages are gained by the above-noted basic arrangement of the invention:

It is possible to step comfortably into the binding, without the skier having to bend over. A reliable grip on the boot is ensured, even with snow on the sole. According to alternative proposed embodiments, the boot sole can be used directly as a holding element, or can form a part of the latching device, thus allowing minimal structural cost. Furthermore, since the axis of rotation running crosswise relative to the longitudinal axis of the ski and boot, around which the boot rotates when lifting the extension from the ski, can be located ahead of the toe part of the boot, a gentle, elastic rolling of the boot on the ski is possible, ensuring sufficient freedom of movement and blood flow to the toe part of the foot. Since only the sole extension is gripped by the binding, the boot sole itself is freely movable and unaffected by friction. The simple design of the cross country ski binding ensures low weight, which is particularly advantagous in racing.

In order to make it possible to put on and take off the ski easily, according to a further feature of preferred embodiments of the invention, the binding is so designed that the boot can be brought into the latching and/or locking position automatically by sliding it lengthwise along the ski. According to some preferred embodiments of the invention, this sliding motion is advantageously performed by moving the boot and sole forward from the rear. However, other preferred embodiments are also contemplated which will allow this sliding motion to be carried out from the front or from above. Advantageously, the latching device is designed so that it effects automatic latching of the sole extension in the supported position (in use skiing position) of the boot against the supporting element, but prevents spontaneous unlatching of the latched boot. Furthermore, the movable latching element is preferably designed as a handle for releasing and/or fastening the latching devide manually or by means of the ski pole. In addition, those latching devices contemplated by the invention are particularly advantageous which latch reliably with snow on the sole or which can be adjusted and/or tightened automatically after the snow on the sole has melted.

In certain preferred embodiments, a latching device is provided which pulls the boot into the support position during the closing process, thus reinforcing the pulling and/or pushing of the boot into the latched and/or locked position.

The present invention contemplates various embodiments, wherein the latching device may be located at any point between the boot sole extension and the supporting element. However, in especially preferred embodiments, it is simplest and most advantageous to install it between the boot extension and a lower part of the supporting element which is integral with the ski. However, the latching device can also be mounted on the upper side or on one or both sides of the boot sole extension according to other contemplated embodiments. When a lever arm is used, for example, in the form of a leaf spring or a wire spring, the swivel axis of the lever arm may run crosswise to and/or in the longitudinal direction of the ski and/or boot, or can run perpendicularly to the surface of the ski according to various preferred embodiments contemplated by the present invention.

In yet other contemplated embodiments an especially simple and advantageous embodiment of the invention consists in using a sole insert embedded in the boot sole as a latching element, especially in the form of an inserted sheet of spring steel. Such a sole insert, known per se in other positions in a ski boot of a type different than that contemplated by the present invention, on the one hand stiffens the boot sole with the boot sole extension and, especially if simultaneously turned outward as a latching element, can be used as a lever arm to release the latching device, thus accommodating releasing of the binding to remove the ski.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 13 is a side view of another embodiment of the invention, in partial cross section along line 13—13 in FIG. 14;

FIG. 14 is a top view of the embodiment in FIG. 13;

FIG. 17 is a top view of an embodiment similar to the embodiment in FIG. 9, but with modifications;

FIG. 18 is a cross section along line 18—18 in FIG. 17;

FIG. 32 is another embodiment of the invention shown in a side view, with a partial cross section, with a latching and locking device in the form of a ratchet; and FIG. 33 is a top view of the embodiment according to FIG. 32.

DETAILED DESCRIPTION OF THE DRAWINGS

Figure 1:
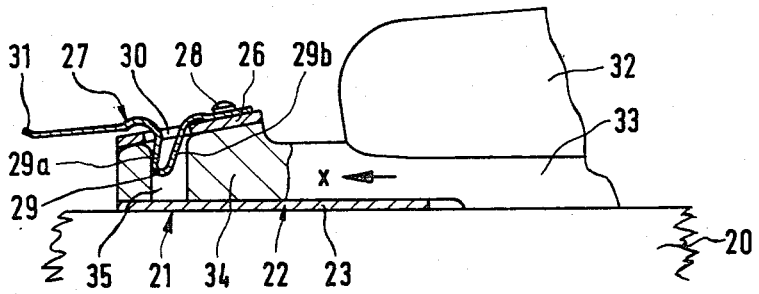
FIG. 1 is a side view of a first embodiment of the invention in partial cross section along line I—I in FIG. 2.
Figure 2:
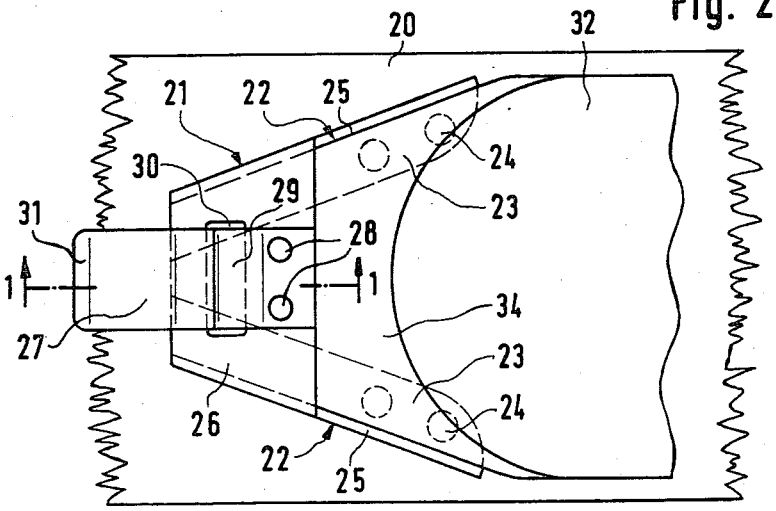
FIG. 2 is a top view of FIG. 1.
Figure 3:
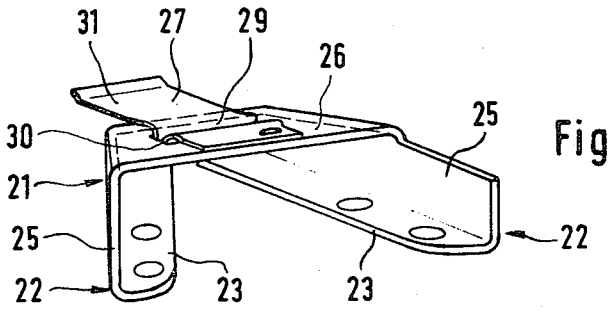
FIG. 3 is a perspective view of the supporting element used in FIGS. 1 and 2.

In the embodiment according to FIGS. 1 to 3, a forward supporting element 21 is fastened to ski 20. This element consists of two angular lateral parts 22, whose lower horizontal legs 23 are fastened to the ski by means of screws 24, while the legs 25 which are perpendicular to the surface of the ski are connected by an upper cover plate 26 to form a box-shaped structure with the U-shaped cross sections of the lateral parts facing one another. In a plan view (FIG. 2), lateral parts 22 form a "V" converging in the forward direction. A latching element 27 in the form of a leaf spring is mounted on coverplate 26 by means of rivets 28 or the like. Spring 27 is disposed in the longitudinal direction of the ski, and is provided in its central part with a bend or crease 29, said bend or crease being U- or V-shaped and directed downward, said bend or crease further projecting through an opening 30 in upper cover plate 26 of supporting element 21. Spring 27 is designed as a handle 31 at its forward end.

The supporting element 21 serves to support boot 32 and/or boot sole 33. For this purpose, the boot sole is provided with a forward sole extension 34, said extension, in a plan view, approximately matching the inner shape of forward supporting element 21 and tapering forward to form a wedge, in such manner that the boot can be slid into the hollow of the supporting element from the rear with its extension 34 moving in the direction of arrow x, until the sole extension comes to rest with its sides fitting like a wedge against the tapered lateral walls 25 and preferably also against the upper cover plate 26, said plate tapering diagonally diagonally and forward, and bend 29 of the leaf spring which serves as latching element 27 meshes with an opening 35 or depression provided in boot sole extension 34.

In this position, shown in the drawing, all of the forces, i.e., all of the forces acting on the boot in the longitudinal direction of the ski as well as all those in the crosswise direction of the ski, and all of the moments, with the exception of the rearwardly directed forces, are received positively by supporting element 21, while the rearwardly acting forces are received by bend 29 in latching element 27. This bend 29 is provided with a forward section 29*a* extending approximately perpendicularly to the surface of the ski, and a section 29*b*, extending diagonally upward and toward the rear, so that as sole extension 34 is slid into place, latching element 27 is automatically raised to latch with opening 35 of the leading edge of the extension, but inadvertent unlatching resulting from movement of the boot in the direction opposite the direction of arrow x is prevented.

To release the binding, latching element 29 is raised at its free end by a a handle 31, so that it leaves opening 30 thus releasing sole extension 34. The boot can then be pulled out of supporting element 21 rearwardly.

Figure 4:
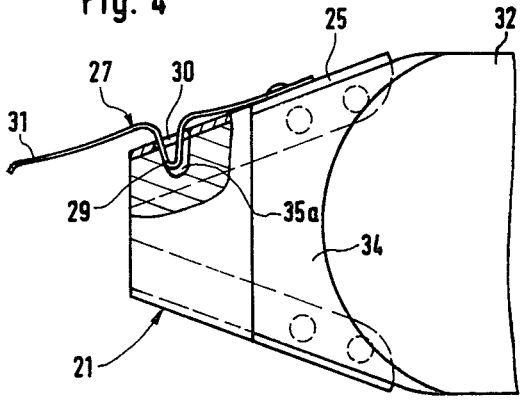
FIG. 4 is a partial view illustrating an alternative embodiment to that of FIG. 2, with a latching element mounted laterally.

The embodiment according to FIG. 4 differs from that in FIGS. 1 to 3 only in that latching element 27 is mounted to one side of supporting element 21 instead of being on the top of the latter, and is also rotatable about an axis perpendicular to the surface of the ski (flexes about a vertical axis through its rigid connection at its rear end with supporting element 21). Instead of an opening 35, continuous from top to bottom, a lateral recess 35*a* is accordingly provided into which the V- or U-shaped bend 29 of latching element 27 fits in the latching position of the boot. Otherwise, it is the same in principle as the embodiment according to FIGS. 1 to 3.

Figure 5:
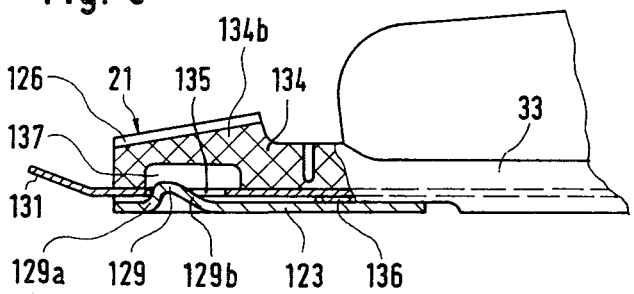
FIG. 5 is a side view of another embodiment of the invention, in partial cross section along line 5—5 in FIG. 6.
Figure 6:
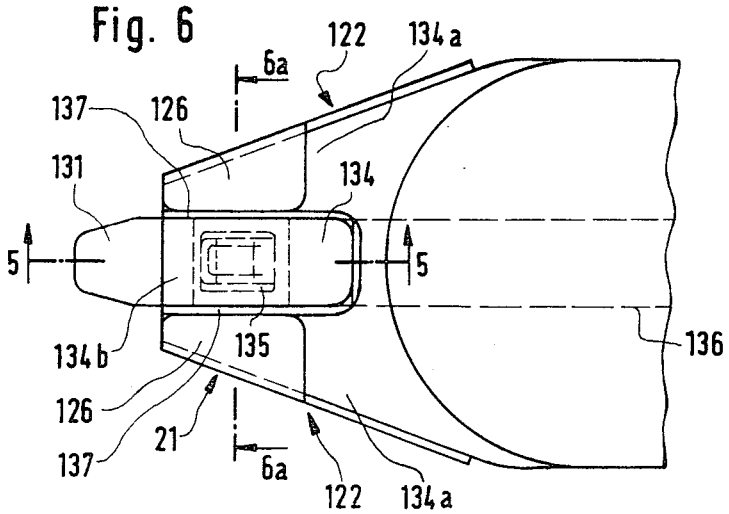
FIG. 6 is a top view of FIG. 5.
Figure 6A:
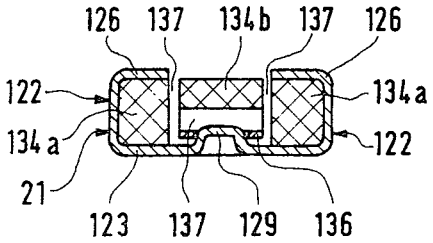
FIG. 6*a* is a cross section along line 6*a*—6*a* in FIG. 6.

In the embodiment according to FIGS. 5 and 6 and/or 6*a*, a flexible sole insert 136 in the form of a strip spring is inserted into the material of boot sole 33, said insert extending outward beyond boot extension 134 and being designed as a latching element and as a handle 131 at its forward end.

Sole insert 136 is provided with a recess or opening 135 to serve as a latching element, into which opening a crimp-like bend 129 of the lower bottom plate 123 of supporting element 21 fits. In order to allow a smooth mesh, sole extension 134 is provided with a recess 137. In addition, in this case bend 129 of bottom plate 123 which serves as a latching element is provided with a forward steep wall part 129*a* and a flatter, diagonal wall part 129*b*. Instead of a continuous upper cover plate, lateral parts 122 of supporting element 21 are provided with two cover plate parts 126 overlapping from the sides, said cover plate parts fitting over the two lateral parts 134*a* of boot sole extension 134. Central part 134*b* of sole extension 134 is separated from the outer parts 134*a* of the sole extension by cutouts 137, so that the central part of the extension can provide additional springing independently of the lateral parts and can carry out sufficient elastic movement when handle end 131 of sole insert 136 is lifted.

Figure 7:
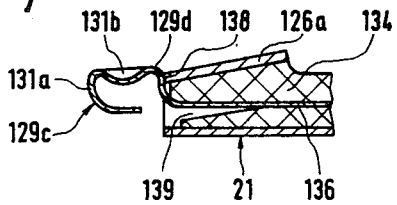
FIG. 7 is a detailed partial, part-sectional view of an alternative embodiment to FIG. 5.

The embodiment according to FIG. 7 differs from those in FIG. 5 and 6 mainly in that sole insert 136 is provided with a bend 129*d* to serve as a latching element 129*c*, said bend cooperating with an edge 138 of cover plate 126*a* which overlaps sole extension 134, said edge serving as a matching latching element. The end of sole insert 136 is bent around to form a handle 131*a*, and is provided with a depression 131*b* on its upper side, said depression also accepting the end of a ski pole so that latching element 129*c* can be brought out of mesh with matching latching element 138 by depressing handle 131*a*. A wedge-shaped slot 139 on the under side of sole insert 136 is designed to permit latching element 129*c* to move sufficiently far to release.

Figure 8A:
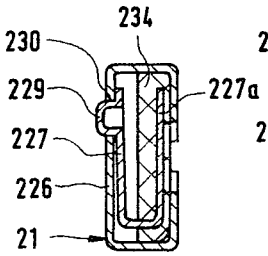
FIG. 8*a* is a cross section along line 8*a*—8*a* in FIG. 8.
Figure 8:
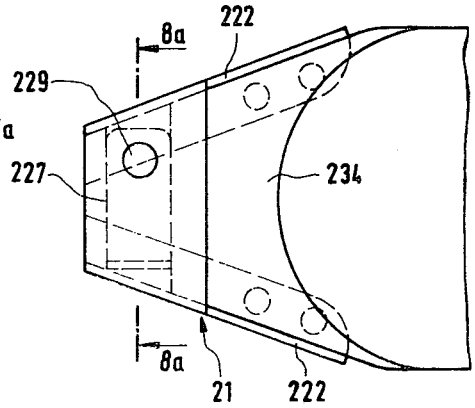
FIG. 8 is a top view of another embodiment of the invention.

The embodiment according to FIGS. 8 and 8*a* is provided with a supporting element 21 with lateral parts 222 and a cover plate 226, corresponding in principle to that shown in FIGS. 1 to 3. The essential difference is that latching element 227 is not mounted in the longitudinal direction but in the transverse direction, and is made in the form of a U-shaped spring strip, imbedded in sole extension 234, especially by injection of the sole material thereabout. In certain preferred arrangements, the lower leg 227*a* of latching element 227 is also a part of a sole insert imbedded in the boot sole and/or the sole extension and extending in the longitudinal direction of the boot. The upper leg of latching element 227 is provided with a hollow pin 229, stamped for example from the sheet. In the latching position, pin 229 meshes with a hole 230, provided as a matching latching element in cover plate 226 of the C-shaped cross section of supporting element 21. The latching device can be released by depressing pin 229.

Figure 9:
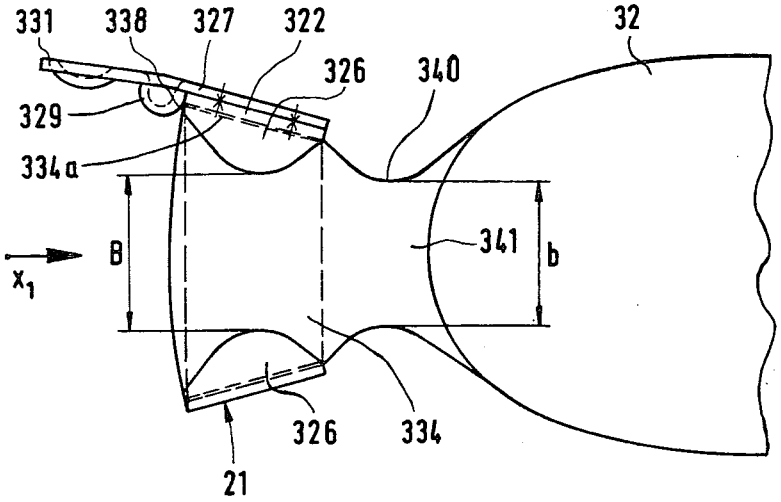
FIGS. 9 and 10 are two further embodiments of the invention in top view.

The embodiment according to FIG. 9 shows a design in which boot 32 is coupled to supporting element 21 by means of its sole extension being moved in the direction of arrow $x_1$. For this purpose, sole extension 334 is provided with a taper 341 produced by lateral arcuate depressions 340, whose width b is equal to or smaller than the opening B between the upper cover plate parts 326 of supporting element 21. Sole extension 334 is initially inserted from above in such manner that arcuate depressions 340 are guided from above between cover plate parts 326. This motion continues until the sole extension comes to rest upon the lower bottom plate of supporting element 21, whereupon the boot together with the sole extension is slid backward in the direction of arrow $x_1$ until it reaches a position shown in FIG. 9. This causes the latching element 327, in the form of a leaf spring, which in this case is tensioned against a lateral part 322, to be pushed aside by tapered edges 334*a* which converge rearward, whereupon convexity 329 of latching element 327 latches the sole extension 334 against edge 338 which acts as a matching latching element.

In this design, all forces and moments, with the exception of a force directed on the boot forward in the longitudinal direction of the ski, are accepted by supporting element 21, while the forces mentioned above, directed forward, are accepted by latching element 327. A special locking element, e.g., a locking lever, can be provided, which prevents inadvertent lateral swiveling of latching element 327 in the latched position. A handle 331 is provided on latching element 327 for opening when desired.

Figure 10:
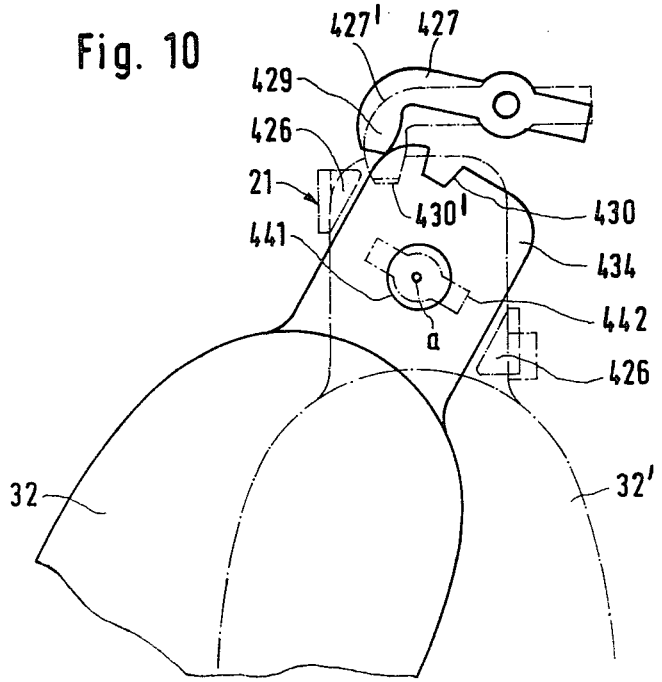

FIG. 10 shows how structural changes of other preferred embodiments allow the skier to step into the binding diagonally from above, swiveling about an axis which is longitudinal or transverse with respect to the ski.

The embodiment according to FIG. 10 shows a design in which the boot is locked in position by rotating it about an axis perpendicular to the surface of the ski. Boot 32 with boot extension 434 is placed on a swivel pin mounted on the ski with axis a from above, by means of a hole 441, then swiveled into position 32' by rotating around axis a. The overlapping parts 426 of a supporting element 21 (not shown in greater detail in the drawing), divided as required to accommodate the boot extension, are tapered in such fashion that they allow boot extension 434 to be applied in the diagonal position shown, but fit laterally over sole extension 434 when the latter is rotated about axis a, thereby preventing sole extension 434 from coming loose when it is in the operating position 32' of the boot shown by a dot-dashed line. A latching lever 427, subject to spring tension in the latched operating position, meshes with its toothed lever end 429 with a toothed groove 430 serving as a matching latching element on sole extension 434, as indicated by the positions outlined by the dot-dashed lines 427' of the latching element and/or 430' of the latching depression. Stops 442 can come to rest against counterstops in the operating position after the boot is rotated from the stepping-in position, thus limiting rotation.

A special locking device not illustrated, may also be provided to prevent sole extension 434 from being lifted off pivot pin with axis a.

In the embodiment according to FIG. 10, forces in the longitudinal direction of the ski are accepted by the pivot pin while all other moments and forces with the exception of torques in a rotational direction about axis a, which are accepted by latching element 427, are accepted by supporting element(s) 21 (426, 427). A pivot pin in the shape of a mushroom can also serve to accept forces acting on the ski from above.

Figure 11:
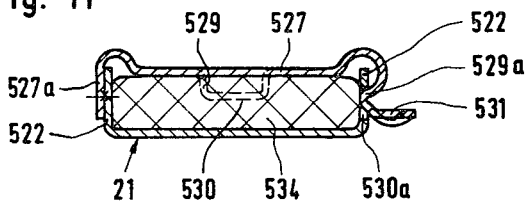
FIG. 11 is a cross section along line 11—11 in FIG. 12.
Figure 12:
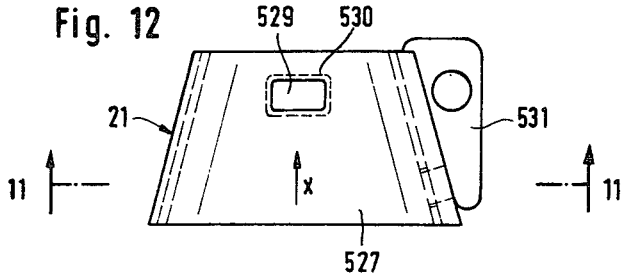
FIG. 12 is a top view of the embodiment in FIG. 11.

The embodiment shown in FIGS. 11 and 12 exhibits a supporting element 21 wherein latching element 527 extends crosswise over sole extension 534. Latching element 527 is designed in the form of a leaf spring, fastened at one end 527*a* to a lateral part 522 of supporting element 21, e.g., welded thereto, and provided at its opposite end with a bulge 529*a*, which in the latching position fits on one side into an opening 530*a* in the opposite lateral part 522. The latching element 527 meshes with sole extension 534 by means of a projection 529, and is also provided with a handle 531. Sliding the sole extension in the direction of arrow x causes bulge 529*a* of latching element 527 to latch into opening 530*a* and causes projection 529 to fit into recess 530, while latching element 527 is raised in a tensioned manner by means of handle 531 and rotates about an axis parallel to the longitudinal direction of the ski and/or boot to release the latter.

Otherwise, the same comments apply to the embodiment according to FIGS. 11 and 12 as to the embodiment in FIGS. 1 to 3. Instead of being in the form of a leaf spring, latching element 527 can also be made in the form of a rigid lever rotatable about an axis longitudinal with respect to the ski, said lever being provided on the side facing sole extension 34 with a leaf spring or another flexible element for flexible support.

The embodiment according to FIGS. 13 and 14 is provided with a wire loop spring 627, with its bent ends articulated in transverse bearing 643, for latching boot sole extension 634 to a ski or a baseplate 623. The spring 627 meshes with respective grooves or cutouts 630 of two pins 641 acting as matching latching elements, said pins 641 being integrally mounted to baseplate 623 and simultaneously serving as mounting pins for boot sole extension 634. Wire loop spring 627 is provided for this purpose with two rearwardly directed loops 629*a* and a likewise rearwardly directed, but preferably displaced in the rotational direction, central loop 629*b*, as well as two forwardly directed loops 629*c*. The latter each mesh with one of the grooves 630 provided one above the other on pins 641.

By appropriate design of the loops and their positions relative to one another, the spring tension with which the sole extension 634 is pressed downward can be varied. Forces acting in the longitudinal and transverse directions of the skis, as well as moments acting in a horizontal plane, are accepted in this form, by supporting element 21 which consists primarily of the baseplate 623 and pins 641, while the upwardly directed forces are accepted by latching element 627. A sole insert 636 made of spring steel is designed with apertures sections in such manner that it serves as a guide for pins 641, thus accepting the moments and forces acting in the horizontal plane.

In this embodiment as well, the design can be modified so that at least one pin 641 is disposed on the boot sole extension 634 and is locked to prevent its movement in the longitudinal direction of the ski by means of a wire loop swivelably mounted on supporting element 21. Thus, the pin can act as a functional element of a sole insert 636 as shown in FIG. 13.

Figure 15:
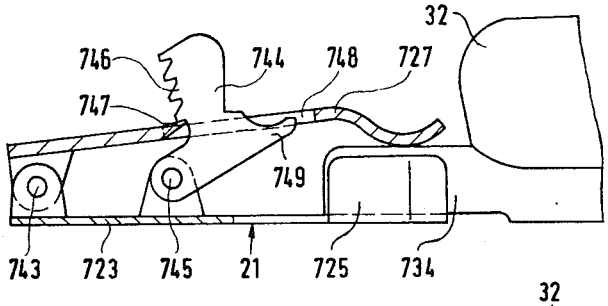
FIG. 15 is another embodiment of the invention in side elevation; in partial cross section along line 15—15 in FIG. 15*a;*
Figure 15A:
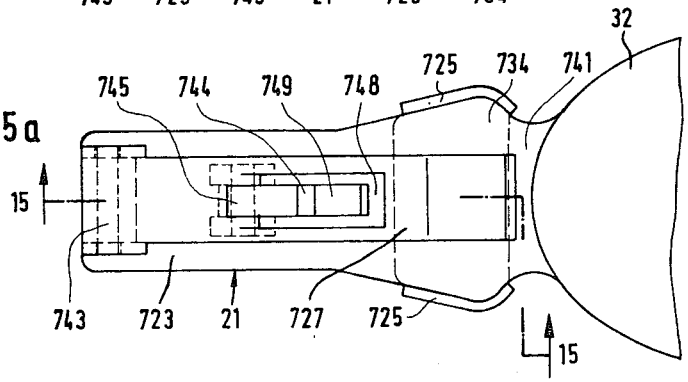
FIG. 15*a* is a top view of FIG. 15.

The embodiment according to FIGS. 15 and 15*a*, like that in FIG. 9, shows a sole extension 734, inserted from above into supporting element 21. As viewed from above, sole extension 734 has a roughly hammer-shaped outline with a constriction, 741. Accordingly, supporting element 21 is provided with a baseplate 723, which is bent at its rearward end to fit the outline of lateral parts 725 which match sole extension 734, said lateral parts grasping the sole extension on both sides in such manner that the extension is immobilized in the longitudinal direction of the ski, and the forces acting in the longitudinal and transverse directions of the ski as well as the moments acting in the horizontal plane are accepted by the supporting element. A latching or locking element 727 resembling a folding cover, articulated about a forward transverse axis 743 on baseplate 723 and pressed more or less flexibly from above upon boot sole extension 734, serves to accept upwardly directed forces, which attempt to force boot sole extension 734 out of mesh with the supporting element. A locking lever 744, swivelably mounted on a transverse joint 745 on baseplate 723 is provided with a toothed segment 746, which makes it possible to lock latching lever 727 in various positions. Teeth 746 cooperate with an edge 747 of latching lever 727 which serves as a matching latching element, whereby locking lever 744 projects through an opening 748 in latching lever 727. By depressing lever arm 749, preferably against the action of a spring tensioned against the lever, latching lever 727 can be unlocked and swiveled forward counterclockwise (FIG. 15) about its rotational axis 743, whereby sole extension 734 can be lifted upward out of lateral parts 725 of supporting part 721.

Depending on the dimensions of boot sole extension 734 and/or the desired tensioning of the latter, teeth 746 can be engaged with specific teeth on lever 727 to produce different degrees of spring tension. In addition, this allows reliable closure when there is snow between boot extension 734 and baseplate 723. If the snow should melt in the course of time, latching lever 727 can be adjusted easily by pushing it down.

The outline of sole extension 734 can have a different shape, for example trapezoidal, double trapezoidal, or the like. In addition, one or more cylindrical pins can be provided perpendicular to the surface of the ski, in order to connect the sole extension with the ski and/or the supporting part, as in FIGS. 10, 13 or 14. In addition, a raisable cover can be provided as a latch spring (corresponding to 727), said cover covering supporting element 21 like a box tightly from above.

Figure 16A:
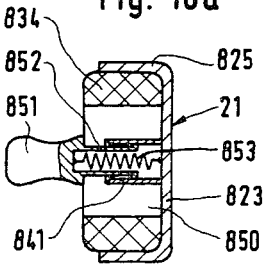
FIG. 16*a* is a cross section along line 16*a*—16*a* in FIG. 16.
Figure 16:
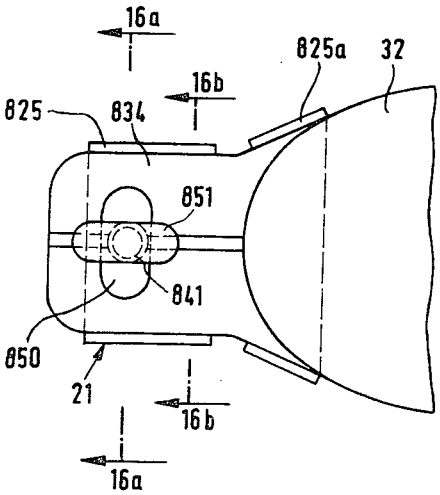
FIG. 16 is a top view of another embodiment of the invention.
Figure 16B:
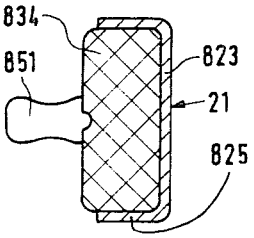
FIG. 16*b* is a cross section along line 16*b*—16*b* in FIG. 16.

In the embodiment according to FIGS. 16, 16*a* and 16*b* the sole extension 834 is once again inserted from above into a U-shaped supporting element 21, open at the top, with lateral walls 825, 825*a*, and a continuous baseplate 823. The sole extension 834 is provided with an oval, slot-shaped opening 850 extending crosswise, by means of which it can be placed over a hollow pin 841 mounted on baseplate 823. A toggle-shaped locking element 851 serves for fastening said element sliding by means of a cylindrical extension 852 in hollow pin 841 and being pressed downward by a spring 853 in such manner that in the position of toggle element 851 shown in FIG. 16, said element comes to rest against the surface of sole extension 834.

To mount sole extension 834 on the ski and/or to mount the latter on supporting element 21, toggle element 851 is brought into position (rotated 90° relative to the position shown in FIG. 16) in such manner that the sole extension can be slid over the toggle element 851 by means of slot-shaped opening 851. After it has been so slid, the toggle element 851 is rotated 90° into the position shown in FIG. 16, thus preventing the sole extension from being lifted off.

All of the forces and moments except those in the longitudinal direction of the ski and/or boot acting rearward on the boot as well as the upwardly directed forces, are once again accepted by supporting element 21, while pin 841 and/or toggle element 851 serves to prevent the sole extension from being pulled out rearward and from being lifted off.

The embodiment according to FIGS. 17 and 18 corresponds to that shown in FIG. 9 to the extent that in this case also, sole extension 334 is initially inserted into supporting element 321 from above and then slid rearward in the direction of arrow $x_1$. A locking lever 327*a*, swivelably mounted in lateral parts 322 of supporting element 321 so that it can move around its bearing pin 327*b*, said lever being further provided with a handle 331, is swiveled forward from a rear (not shown) position counterclockwise into its forward latched position as shown to prevent the sole extension from being pulled out inadvertently, in which position the tensioned loop-like latching element 329*a* of locking level 327*a* meshes with a forward latching groove 330 on sole extension 334.

Figure 19:
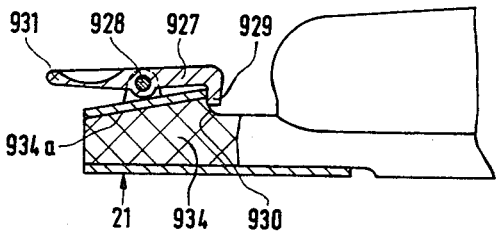
FIG. 19 is another embodiment of the invention shown in a side view, in partial cross section.

In the embodiment according to FIG. 19, which resembles that in FIG. 1, a latching lever 927 is provided to latch sole extension 934, said lever being articulated at 928 on supporting element 21 and meshing by means of its rear latching nose 929 in the operating position of the ski boot in a latching depression 930 under the influence of a spring (not shown). When the boot extension is slid forward, latching nose 929 is raised by sloping surface 934*a* of the boot extension until it meshes with the latch. To release the boot, handle 931 is depressed manually or by using a ski pole.

Figure 20:
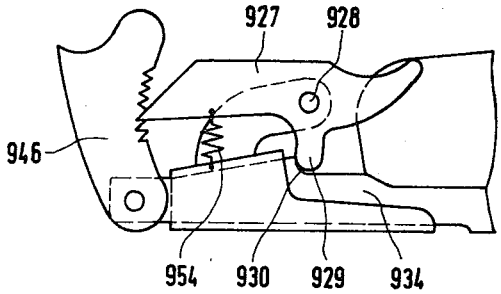
FIG. 20 is another embodiment of the invention shown in a side view.

The embodiment shown in FIG. 20 differs from the previous embodiments essentially in that latching element 927, once again in the form of latching lever, is pulled out of its latched a position by a spring 954, but is held in mesh with a toothed segment 946 by means of spring tension. If snow which may be present beneath the boot melts away, pulling latching element 927 causes the boot to be pulled forwardly into the supporting device.

Figure 21:
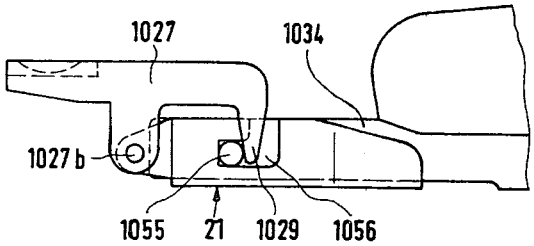
FIG. 21 is another embodiment of the invention shown in a side view.
Figure 22:
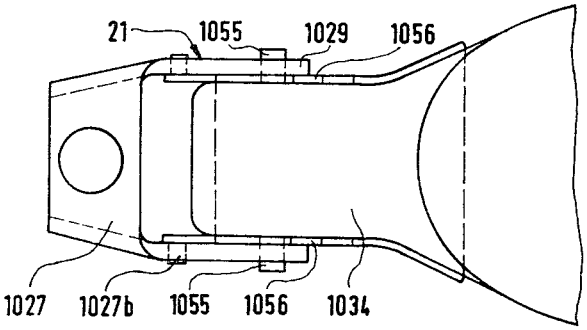
FIG. 22 is a top view of the embodiment shown in FIG. 21.

In the embodiment according to FIGS. 21 and 22, boot extension 1034 is provided with two lateral pins 1055, which are guided into lateral angular slots 1056 when the boot is inserted from above, and are brought into the forward latched position shown by sliding the boot forward. In this position, they are gripped by the latching nose 1029 of the latching or locking lever 1027, said lever being swivelably mounted at 1027*b* on supporting element 21 and forced into the position shown by a spring for example. However, it is also contemplated to provide an angular slot 1056 extended further backward, so that the boot can be inserted from above and brought into the latched position by sliding it backward.

Figure 23:
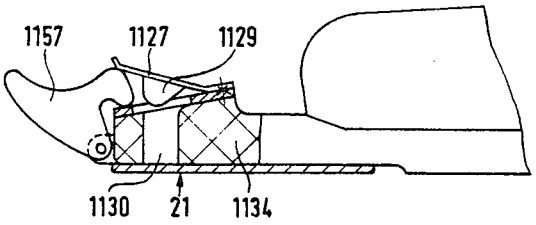
FIG. 23 is another embodiment of the invention shown in a side view, in partial cross section, in the unlatched position.
Figure 24:
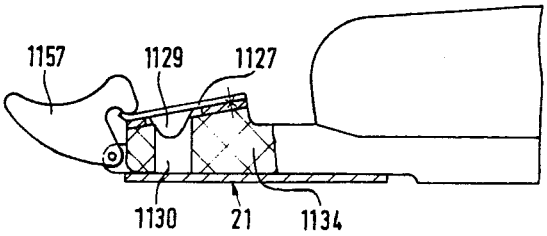
FIG. 24 is the same embodiment as in FIG. 23, but in the latched and locked position.

In the embodiment shown in FIGS. 23 and 24, the spring-loaded latching element 1127 is held in opening 1130 in sole extension 1134 by means of its projection 1129 and is locked in its latched position (FIG. 24) by locking lever 1157. Projection 1129 pulls sole extension 1134 forward by means of its leading edge, if the boot extension is not yet in its forward locked position in supporting element 21. The boot extension is freed by depressing locking lever 1157 and raising latching lever 1127.

Figure 25:
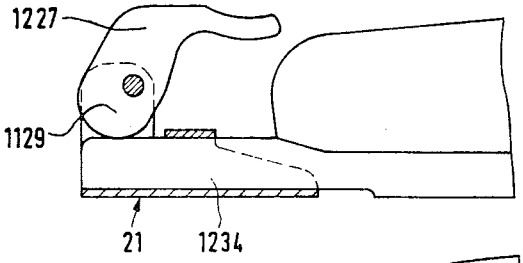
FIG. 25 is another embodiment of the invention with a clamping element as the latching element, shown in a side view.
Figure 26:
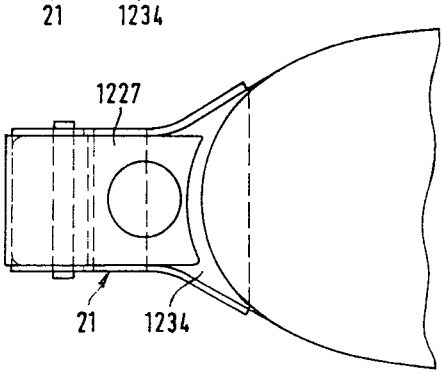
FIG. 26 is a top view of the embodiment according to FIG. 25.

FIGS. 25 and 26 show an embodiment wherein sole extension 1234 is held in place by a clamp in the form of an eccentric latching lever 1227 pivoted on supporting element 21 with an eccentric 1229 in its operating position, being automatically locked by friction. A spring (not shown) can force lever 1227 into the position shown. The sole extension can be slid into the supporting element either from the right (as shown in the drawing) or from the left. The binding can be released either by depressing latching lever 1227 or otherwise, by prying it loose with a ski pole.

Figure 27:
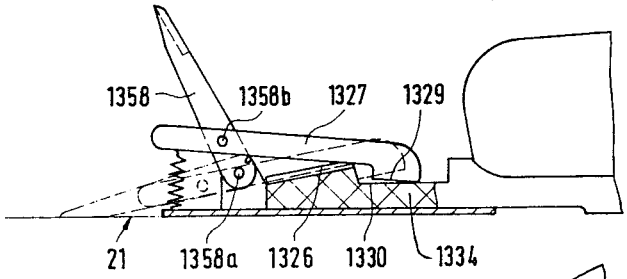
FIG. 27 is another embodiment of the invention shown in a side view, in a partial cross section, with a tensioning lever.
Figure 28:
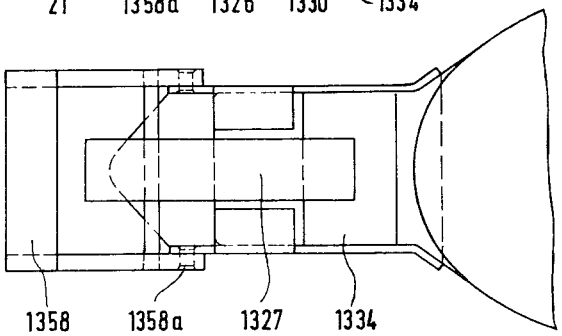
FIG. 28 is a top view of the embodiment shown in FIG. 27.

The embodiment shown in FIGS. 27 and 28 shows a tensioning lever 1358 articulated at 1358*a* on supporting element 21, said lever in turn supporting latching lever 1327 at 1358*b*, the latching nose 1329 of said latching lever fitting into latching depression 1330 of sole extension 1334. By swiveling tensioning lever 1358, latching lever 1327 and hence sole extension 1334 are pulled forwardly firmly beneath the sloping coverplate 1326 of supporting element 21.

Figure 29:
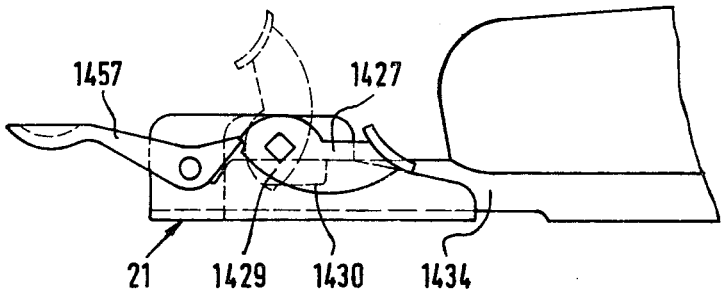
FIG. 29 is another embodiment of the invention shown in side view with a locking lever.
Figure 31:
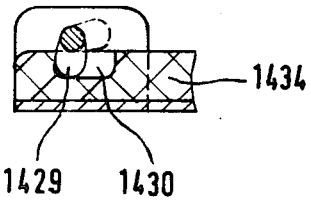
FIG. 31 is a cross section along line 31—31 in FIG. 30.
Figure 30:
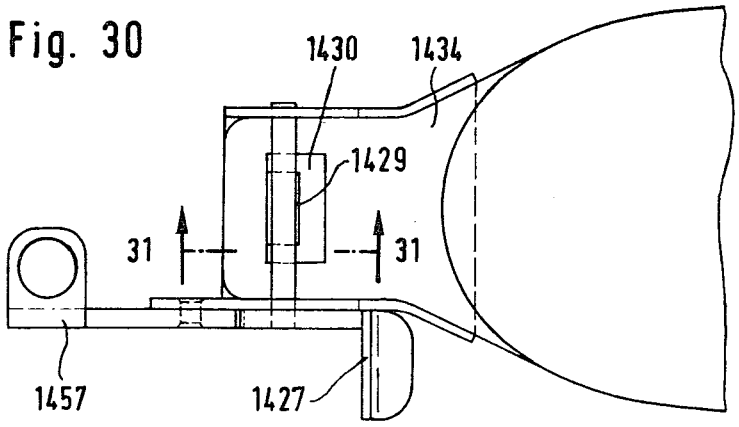
FIG. 30 is a top view of the embodiment according to FIG. 29.

In the embodiment according to FIGS. 29 to 31, as in FIGS. 25 and 26, a latching lever 1427 serves as a latching element, with an eccentric 1429 as a clamping element. A locking lever 1457 keeps the latching lever in its latched position in the manner of a ratchet and pawl.

In the embodiment according to FIGS. 32 and 33, a latching device which operates in the manner of a ratchet serves to latch sole extension 1534. A latching lever 1527 is swivelably mounted on supporting element 21 with baseplate 1523, side walls 1525, and a coverplate 1526 guiding the sole extension along its upper surface, said lever having a rotational axle 1529*a* which is perpendicular, firmly connected to it, and rotatable in the lateral walls 1525 of the supporting element. Transverse axle 1529*a* in turn supports a ratchet 1529 with teeth 1559 sloping in one direction, into which a pawl 1560 fits, said pawl being mounted on latching lever 1527, preferably under spring tension in such manner that ratchet 1529 can turn only clockwise with respect to latching lever 1527 as shown in FIG. 32. A tooth-like projection 1529*b* meshes with a depression 1535 in sole extension 1534 in the latched position. In addition, a locking lever 1557 is articulated on supporting element 21, said lever likewise meshing with the teeth 1559 of the ratchet under the influence of a spring 1561 by means of a pawl 1562, preventing latching lever 1527 from being lifted and pivoted about its rotational axis 1529*a* in the opening direction, i.e., counterclockwise.

To insert the sole extension 1534 in the support element, locking lever 1557 is depressed by means of its handle 1531, either manually or with a ski pole, so that pawl 1562 comes out of mesh, with teeth 1559, whereupon latching lever 1527 can be lifted and the sole extension slid in from the rear. Then latching lever 1527 is swiveled down once more so that projection 1529*b* comes to rest against stop 1535*a* of depression 1535 as shown in FIG. 32. When locking lever 1557 is raised, pawl 1560 can be brought into mesh with the next tooth on tooth section 1559 in the circumferential direction by moving latching lever 1527 back and forth, thus pulling sole extension 1534 further into supporting element 21, up against a stop if necessary, thereby tensioning it in supporting element 21. A spring can be provided which attempts to hold ratchet 1529 in mesh with pawl 1560, as well as a handle, e.g., a lever arm, which serves to bring pawl 1560 out of mesh with the ratchet. It is also advantageous to provide a lever arm on a rotational axle 1529*a* firmly mounted on ratchet 1529, in order to be able to adjust the ratchet relative to latching lever 1527 externally in the rotational direction. In order to remove the binding, locking lever 1557 is once again depressed, whereupon the boot together with sole extension 1534 can be pulled out rearwardly as latching lever 1527 is swiveled upwardly.

In all cases, the latching lever or locking lever may be constructed so that they are operable by a ski pole, including a lever arm with an appropriately designed recess or cutout, so that when the ski pole is inserted properly, the latter can be used as an extended lever arm.

The embodiments described hereinabove can be varied in many ways according to other contemplated preferred arrangements of the present invention. Thus, a special locking element, e.g., a locking lever, can be provided in all cases, which locks the latching element in the latched position, so that inadvertent release of the latching device is prevented. Such locking lever can be swivelably mounted about any, e.g., horizontal, transverse, or longitudinal axis, or a vertical axis. The locking element and/or locking lever can be mounted at any appropriate point above, in front of, or beside, the sole extension, or even within recesses in the latter. In addition, locking slides or the like can be used instead of locking levers.

In all cases, versions are also contemplated wherein the latching element, as an articulated or spring-loaded latching lever, is swivelably mounted relative to an axis extending at right angles to the longitudinal direction of the ski, in the longitudinal direction of the ski, as well as vertical to the surface of the ski. In addition, multiple or fine ratchet teeth can be provided, thus allowing latching with boots of different sizes or with boot extensions of different lengths, and allowing reliable retention of the boot even when there is snow on the bottom of the latter and/or the snow melts away subsequently. This allows tolerances between the boot and the binding, so that the factors which promote wear are eliminated.

Likewise, a spring loop can be used in all cases as a latching element, said loop meshing with a corresponding projection or a corresponding depression or the like when the boot is in the latched position. A depression or projection which serves as a matching latching element can be provided on the under side or the upper side of the boot extension.

Likewise, it is also contemplated to provide kinematic variations, for example in such manner that instead of having a depression or a recess in boot sole extension 34, as shown for example in the embodiments according to FIGS. 1 to 3, an elevated projection is provided with which a corresponding convexity or recess serving as a matching latching element can mesh.

Moreover, the features of the individual embodiments can be combined with one another, and the latching elements and matching latching elements can be reversed kinematically between the boot sole extension and the supporting element, according to yet further contemplated embodiments of the invention. The invention also relates to the individual measures (subcombination features disclosed) as such, to the extent that these are novel and are neither disclosed nor taught by the state of the relevant art.

Exemplary of further contemplated embodiments, heel plates, known of themselves, can be used for guide elements for the heels with such plates mounted on the skis, in combination with the front binding of the embodiments illustrated and described. It is advantageous in this connection for the heel plates to be adjusted for different kinds of snow, and mounted and especially clipped in place as needed or as a function of the quality of the snow.

Also, wedge-shaped fittings on the soles can be provided which slope upwardly and forwardly for example to allow better rolling of the boot sole and/or boot sole extension on the ski, or to provide a baseplate for the supporting element. It is also advantageous to have a snow plow-like design for the supporting element, in order to prevent snow from entering the binding area.

If desired, it is also contemplated to extend the upper part of the boot (cap) further forward instead of or as well as the boot sole, and to support, latch, and lock it in position by means of an appropriately designed supporting element. The expression "sole extension" therefore, also applies to a similar boot extension, according to further non-illustrated contemplated embodiments.

However, those embodiments illustrated and described in detail are the presently preferred embodiments of the invention.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Cross country ski binding assembly comprising:

forward ski boot support element means fixedly attachable to a ski, said support element means including forwardly converging guiding sidewall portions supportingly engageable with a flexible forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and a holding portion for surroundingly holding a thickened end portion of said forward sole extension, and resiliently biased latching means for latching said thickened end portion of the sole extension to said ski, said latching means including a resilient latching member on one of said holding portion and thickened end portion for automatically engaging with a surface on the other of said holding member and thickened end portion in response to insertion of said thickened end portion into said holding portion to resiliently force said sole extension forwardly against said converging portions to retain said sole extension in a position with said portions of said support element means supportingly engaging said sole extension to assist said latching means in maintaining said forward sole extension and therewith the ski boot in an in-use skiing position.

2. Cross country ski binding assembly according to claim 1, wherein the latching means and support element means includes means for accommodating latching of said latching means in response to sliding of said sole extension along the longitudinal direction of the ski.

3. Cross country ski binding assembly according to claim 1, wherein said support element means is configured with respect to the sole extension such that the sole extension is positively supported on all sides except at the rear by the support element means, and wherein only the forces acting backward on the ski boot are accepted by the latching means.

4. Cross country ski binding assembly according to claim 1, wherein the resilient latching member is disposed between the sole extension and one of a baseplate of the support element means fixedly attached to the ski and a lower part of the support element means mounted to said baseplate and/or on the ski.

5. Cross country ski binding according to claim 1, wherein said resilient latching member is disposed between the sole extension and one of an upper part and a lateral part of the support element means.

6. Cross country ski binding assembly according to claim 1, wherein the resilient latching member comprises a movable latching element, said movable latching element, when the boot is in the latched position, engaging by means of a projection in a recess which serves as a matching latching element.

7. Cross country ski binding assembly according to claim 6, wherein the movable latching element is disposed on the support element means and the matching latching element is disposed on the sole extension.

8. Cross country ski binding assembly according to claim 6, wherein the movable latching element can be intentionally moved out of the latched position externally, both manually and by using a ski pole.

9. Cross country ski binding assembly according to claim 6, wherein the movable latching element is designed at its free end as a handle for accommodating operation by means of a ski pole engageable therewith.

10. Cross country ski binding assembly according to claim 1, wherein a sole insert imbedded in the boot sole, especially a steel spring strip, is provided as said resilient latching member.

11. Cross country ski binding assembly according to claim 10, wherein the sole insert at the end thereof which is extended beyond the sole extension is designed as a handle for accommodating unlatching of the latching means.

12. Cross country ski binding assembly according to claim 11, wherein the sole insert is formed with means for meshing with a baseplate of the support element means, said surface that is engageable by said resilient latching member being formed on said baseplate.

13. Cross country ski binding assembly according to claim 11, wherein the sole insert imbedded in the sole extension extends outward and forward beyond the sole extension and is engaged at the rear by an edge part of the support element means which serves as said surface that is engageable by said resilient latching member.

14. Cross country ski binding assembly according to claim 10, wherein the sole insert is formed with means for meshing with a baseplate of the support element means, said surface that is engageable by said resilient latching member being formed on said baseplate.

15. Cross country ski binding assembly to claim 10, wherein the sole insert imbedded in the sole extension extends outward and forward beyond the sole extension and is engaged at the rear by an edge part of the support element means which serves as said surface that is engageable by said resilient latching member.

16. Cross country ski binding assembly according to claim 10, wherein the sole extension is formed with a recess below the sole insert in an area where the latter emerges in order to increase the spring action of the latter.

17. Cross country ski binding assembly according to claim 1, wherein said latching means includes a latching lever, the swivel axis of the latching lever extending crosswise with respect to the longitudinal direction of the ski and/or boot.

18. Cross country ski binding assembly according to claim 1, wherein said latching means includes a latching lever, the swivel axis of the latching lever extending at right angles to the longitudinal direction of the ski and/or boot.

19. Cross country ski binding according to claim 1, wherein said converging portions of the forward ski boot support element means extend rearwardly of the latching means for laterally holding portions of said sole extension located rearwardly of the position where said latching means engages the sole extension when said sole extension is in said in-use skiing position.

20. Cross country ski binding assembly according to claim 19, wherein said forward ski boot support element means including said lateral extensions has a width which is smaller than the width of the ski.

21. Cross country ski binding assembly according to claim 1, wherein said forward ski boot support element means has rearwardly directed lateral extensions for laterally holding portions of said sole extension located rearwardly of the position where said latching means engages the sole extension when said sole extension is in said in-use skiing position.

22. Cross country ski binding assembly according to claim 21, further comprising a ski to which said forward ski boot support element means is fixedly attached, and wherein said forward ski boot support element means including said lateral extensions has a width which is smaller than the width of the ski.

23. Cross country ski binding assembly according to claim 1, further comprising a ski boot with said sole extension, the foremost end part of said sole extension having a greater cross section than portions of said sole extension at said cross axis intermediate the toe part of the boot and the foremost end part, to facilitate said pivotal elastic rolling movement of the ski boot and sole extension about said cross-axis.

24. Cross country ski binding assembly according to claim 1, wherein the resilient latching member of said latching means is in the form of a leaf spring which is fixedly attached to said support element means, said leaf spring including a bent part engageable in a recess in said sole extension.

25. Cross country ski binding assembly according to claim 24, wherein said leaf spring is fixedly attached to said support element means at a position rearwardly of said recess when said sole extension is in the in-use skiing position.

26. Cross country ski binding assembly according to claim 25, wherein said leaf spring has a free forward end which forms a release handle.

27. Cross country ski binding assembly according to claim 1, wherein said forwardly converging sidewall portions are wedge-shaped so as to enable the sole extension to rest with its sides fitting like a wedge against the converging sidewall portions.

28. Cross country ski binding assembly comprising:

forward ski boot support element means fixedly attachable to a ski, said support element means including portions supportingly engageable with a forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching the sole extension to said ski, said latching means being movable against a resilient return force from a latching position to a release position, said latching means being configured so that said sole extension automatically moves said latching means toward said release position to accommodate insertion of said sole extension to a predetermined in use skiing position with said latching means then automatically moving to said latching position to latch said sole extension with said portions of said support element means supporting engaging said sole extension to assist said latching means in maintaining said sole extension in said in-use position, wherein a sole insert imbedded in the boot sole, especially a steel spring strip, is provided as one of a latching and matching element for said latching means, the sole insert is in mesh and/or can be brought into mesh with a baseplate of the support element means by means of the latching element and matching latching element, and the sole insert includes a recess or a bend, and wherein a baseplate integral with the ski is provided with a bend which meshes with said recess or bend in the sole insert when the boot is in the latched position.

29. Cross country ski binding assembly comprising:

forward ski boot support element means fixedly attachable to a ski, said support element means including portions supportingly engageable with a forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching the sole extension to said ski, said latching means being movable against a resilient return force from a latching position to a release position, said latching means being configured so that said sole extension automatically moves said latching means toward said release position to accommodate insertion of said sole extension to a predetermined inuse skiing position with said latching means then automatically moving to said latching position to latch said sole extension with said portions of said support element means supportingly engaging said sole extension to assist said latching means in maintaining said sole extension in said in-use skiing position, wherein said latching means is in the form of a leaf spring which is fixedly attached to said support element means, said leaf spring including a bent part engageable in a recess in said sole extension, said leaf spring is fixedly attached to said support element at a position rearwardly of said recess when said sole extension is in the in-use position, said leaf spring has a free forward end which forms a release handle, and wherein said leaf spring is fixedly attached to the top of the support element means.

30. Cross country ski binding assembly comprising:

forward ski boot support element means fixedly attachable to a ski, said support element means including portions supportingly engageable with a forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching the sole extension to said ski, said latching means being movable against a resilient force from a latching position to a release position, said latching means being configured so that said sole extension automatically moves said latching means toward said release position to accommodate insertion of said sole extension to a predetermined in-use skiing position with said latching means then automatically moving to said latching position to latch said sole extension with said portions of said support element means supportingly engaging said sole extension to assist said latching means in maintaining said sole extension in said in-use skiing position, wherein said latching means is in the form of a leaf spring which is fixedly attached to said support element means, said leaf spring including a bent part engageable in a recess in said sole extension, said leaf spring is fixedly attached to said support element at a position rearwardly of said recess when said sole extension is in the in-use skiing position, said leaf spring has a free forward end which forms a release handle, and wherein said leaf spring is fixedly attached to a sidewall of said support element.

31. Cross country ski binding assembly comprising:

forward ski boot support element means fixedly attachable to a ski, said support element means including forwardly converging guiding sidewall portions supportingly engageable with a flexible forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching an end portion of the sole extension to said ski, said latching means including a resilient member directly engageable with a surface on said sole extension to resiliently force said sole extension forwardly against said converging portions to retain said sole extension in a position with said portions of said support element means supportingly engaging said sole extension to assist said latching means in maintaining said forward sole extension and therewith the ski boot in an in-use skiing position, wherein said latching means is in the form of a leaf spring which is fixedly attached to said support element means, said leaf spring including a bent part engageable in a recess in said sole extension, said leaf spring is fixedly attached to said support element means at a position rearwardly of said recess when said sole extension is in the in-use skiing position, and wherein said leaf spring is fixedly attached to the top of the support element means.

32. Cross country ski binding assembly comprising:

forward ski boot support element means fixedly attachable to a ski, said support element means including portions supportingly engageable with a forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching the sole extension to said ski, said latching means including a resilient member directly engageable with a surface on said sole extension to resiliently force said sole extension toward a position with said portions of said support element means supportingly engaging said sole extension to assist said latching means in maintaining said forward sole extension and therewith the ski boot in said in-use skiing position, wherein said latching means is in the form of a leaf spring which is fixedly attached to said support element means, said leaf spring including a bent part engageable in a recess in said sole extension, said leaf spring is fixedly attached to said support element means at a position rearwardly of said recess when said sole extension is in the in-use skiing position, said leaf spring has a free forward end which forms a release handle, and said leaf spring is fixedly attached to a sidewall of said support element means.

33. Cross country ski binding assembly comprising:

forward ski boot support element means fixedly attachable to a ski, said support element means including forwardly converging guiding sidewall portions supportingly engageable with a forward sole extension of a ski boot in such a manner as to permit lifting of the rear part of said ski boot from the ski, with a pivotal elastic rolling movement of the ski boot and sole extension about a cross-axls located at the sole extension forwardly of the toe part of the boot, and resiliently biased latching means for latching an end portion of the sole extension to said ski, said latching means including a resilient member directly engageable with a surface on said sole extension to resiliently force said sole extension forwardly against said converging portions to retain said sole extension in a position with said portions of said support element means supportingly engaging said sole extension to assist said latching means in maintaining said forward sole extension and therewith the ski boot in an in-use skiing position, wherein said forwardly converging sidewall portions are wedge-shaped so as to enable the sole extension to rest with its sides fitting like a wedge against the converging sidewall portions, and wherein said support element means further comprises an upper guiding wall portion, said upper guiding wall portion extending between said sidewall portions and being diagonally downwardly and forwardly directed so as to enable an upper portion of the forward sole extension to fit thereagainst.

34. Cross country ski binding assembly according to claim 33, wherein the wedge-shaped wall portions and the upper guiding wall portion form a housing which is open at the rear, so that the sole extension can be slid inward from the rear until it is supported against the wall portions forming the housing in a latched manner.

35. Cross country ski binding assembly comprising:

forward ski boot support element means fixedly attachable to a ski, said support element means including forwardly converging guiding sidewall portions supportingly engageable with a forward sole extension of a ski boot in such a manner as to permit lifting of the rear part of said ski boot from the ski, with a pivotal elastic rolling movement of the ski boot and sole extension about a cross-axis located at the sole extension forwardly of the toe part of the boot, and resiliently biased latching means for latching an end portion of the sole extension to said ski, said latching means including a resilient member directly engageable with a surface on said sole extension to resiliently force said sole extension forwardly against said converging portions to retain said sole extension in a position with said portions of said support element means supportingly engaging said sole extension to assist said latching means in maintaining said forward sole extension and therewith the ski boot in an in-use skiing position, wherein said latching means is in the form of a leaf spring which is fixedly attached to said support element means, said leaf spring including a bent part engageable in a recess in said sole extension, and wherein said bent part is U-shaped.

36. Cross country ski binding assembly according to claim 35, wherein a rearward leg of the U-shaped bent part is inclined forward.

37. Cross country ski binding assembly according to claim 35, wherein a forward leg of the U-shaped bent part is extended forwardly as a handle forming means for lifting the leaf spring out of the recess in the sole extension.

38. A ski binding, especially of the touring or cross country type, in which the ski boot is held by a front extension of the sole of the boot which engages itself in an archplate secured to the ski, said archplate having a stationary horizontally extending upper part and defining an area whose form corresponds in width and height to that of the extension of the sole, fastening means connected to the archplate and including a fastening element movable downwardly from above said extension of the sole and engageable with an upwardly opening stop surface situated on an upper portion of the extension between the front of the archplate and the body of the boot to fasten the boot to the ski, wherein said fastening means comprises a linkage of a plurality of pivotally connected levers, wherein said fastening element is located at a first end of a first of said levers, wherein a second one of said levers is pivotally connected to said archpalte adjacent a first end thereof and is also pivotally connected to said first lever at a location longitudinally displaced from the fastening element in a manner causing said linkage to be operative for enabling said fastening element to execute both a downward swinging movement toward said stop and a forward movement applying a force to said front extension directed into said archplate, when said binding is shifted from a disengaged position to an engaged position.

39. Ski binding according to claim 38, wherein a second, free, end of said second lever is arranged, as part of said linkage, for producing said swinging and forward movements by manipulating a free end thereof.

* * * * *